US005883462A

United States Patent [19]

Ushifusa et al.

[11] Patent Number: 5,883,462

[45] Date of Patent: Mar. 16, 1999

[54] AC GAS DISCHARGING TYPE DISPLAY PANEL WITH METAL PARTITION MEMBER

[75] Inventors: Nobuyuki Ushifusa, Yokohama; Seiichi Tsuchida, Yokosuka; Eiji Matsuzaki, Yokohama; Teruo Takai, Isehara, all of Japan

[73] Assignee: Hitachi, Ltd., Tokyo, Japan

[21] Appl. No.: 774,490

[22] Filed: Dec. 30, 1996

[30] Foreign Application Priority Data

Jan. 11, 1996 [JP] Japan ..... 8-003219

[51] Int. Cl.[6] ..... H01J 1/88

[52] U.S. Cl. ..... 313/292; 313/493; 313/634; 313/259

[58] Field of Search ..... 313/493, 495, 313/514, 518, 582, 584, 586, 634, 250, 252, 253, 257, 259, 260, 268, 292

[56] References Cited

U.S. PATENT DOCUMENTS

| | | | |
|---|---|---|---|
| 3,842,308 | 10/1974 | Van Esdonk et al. . | |
| 3,845,241 | 10/1974 | Schwartz . | |
| 4,060,749 | 11/1977 | Shinada et al. | 313/484 |
| 4,315,259 | 2/1982 | McKee et al. . | |
| 5,384,514 | 1/1995 | Kim | 313/584 |
| 5,532,548 | 7/1996 | Spindt et al. | 313/292 |
| 5,561,343 | 10/1996 | Lowe | 313/496 |

FOREIGN PATENT DOCUMENTS

| | | |
|---|---|---|
| 0 004 549 A1 | 10/1979 | European Pat. Off. . |
| 0 123 496 A2 | 10/1984 | European Pat. Off. . |

*Primary Examiner*—Vip Patel

*Attorney, Agent, or Firm*—Antonelli, Terry, Stout & Kraus, LLP

[57] ABSTRACT

A partition member for a gas discharge display panel having a front substrate with at least one main discharge electrode spaced from a back substrate having at least one auxiliary discharge electrode so as to delimit a gap therebetween. The partition member is adapted to extend substantially parallel to and between the front and back substrates for forming a main discharge space on a front substrate side and an auxiliary discharge space on a back substrate side, the partition member being a metal material member. A gas discharge display panel incorporates the partition member and a system is provided for driving the gas discharge display panel. Also, a manufacturing method is provided for the partition member and gas discharge display panel.

17 Claims, 10 Drawing Sheets

1
2
3
4a
4b
5a
5b
5c
6a
6b
7a
7b
8a
8b
9
9, 9a
9, 9b
11
11a
11b
12
12a
12b
13
13a
13b
14
31
32
33
3a
3e
81
81, 11b
81, 12b
81, 13b
140

AC GAS DISCHARGING TYPE DISPLAY PANEL WITH METAL PARTITION MEMBER

CROSS REFERENCE TO RELATED APPLICATIONS

This application is related to U.S. application Ser. No. 08/525,975, now U.S. Pat. No. 5,716,082, entitled Gas Discharge Display Panel, filed Sep. 7, 1995 and copending U.S. application Ser. No. 08/744,759, entitled Plasma Display Panel Driving System and Method, filed Nov. 6, 1996.

BACKGROUND OF THE INVENTION

The present invention relates to a gas discharging display panel such as a plasma display panel and a manufacturing method and, more particularly, to an AC-driven gas discharging type display panel suitable for color display and capable of providing a high accuracy and high contrast display and which is inexpensive.

A gas discharging display panel such as a plasma display has such features that a view angle is wide, the display is easy to see because of self emission, and it can be fabricated with a reduced thickness, which is utilized as a display device for OA (office automation) equipments, as well as expected for application uses such as high quality television receivers.

The gas discharging type display panel is generally classified into a DC driven type and an AC driven type. Among them, the AC driven type panel has a memory function by the effect of a dielectric layer covering an electrode and has high luminosity. Further, with application of a protective film, a working life endurable to practical use can be obtained even also for the AC driven type in recent years, and it is put to practical use for example, in multipurpose video monitors.

FIG. 4 shows a perspective view of a portion of a plasma display panel which is presently used. The gas discharging type color display panel comprises a back substrate 2 and a front substrate 1 opposed to each other. The back substrate 2 has barrier ribs 3*a* for maintaining a gap with the front substrate 1 constant, and the front substrate 1 and the back substrate 2 are connected by way of the barrier ribs 3*a*. In FIG. 4, the front substrate 1 and the barrier ribs 3*a* of the back substrate 2 are separately shown for ease of viewing.

The front substrate 1 has a structure including display electrodes (transparent electrode) 5, buss electrodes 6 made of a metal conductor, an insulator layer 7 and an MgO film (protective film) 8 which are formed on a front glass plate 4*a*. The back substrate 2 has a structure including address electrodes 9, barrier ribs 3*a* and a fluorescent layer 14 which are formed on a back glass plate 4*b*. A discharging space 3*f* is formed between the front substrate 1 and the back substrate 2 by disposing and appending the front substrate 1 and the back substrate 2 in parallel with each other such that respective surfaces formed with the electrodes are opposed to each other. The display electrodes 5 and the address electrodes 9 are made orthogonal to each other by way of the discharging space 3*f*.

FIG. 5(*a*)–(*c*) and FIG. 6 show cross sectional views of the gas discharging type display panel of FIG. 4. FIG. 5(*a*) is a cross sectional view when cutting a portion of the display panel along a plane parallel with the address electrodes 9 and vertical to the surface of the substrates 1, 2. FIG. 5(*b*) is a cross sectional view at a position A in FIG. 5(*a*) and the cutting plane is vertical to the address electrodes 9 and vertical to the surface of the substrates 1, 2. FIG. 5(*c*) is a cross sectional view at a position B in FIG. 5(*a*) and the cutting plane is vertical to the address electrodes 9 and vertical to the surface of the substrates 1, 2. In FIG. 5(*a*)–(*c*), only the cross section is shown for making the drawing easy to view while the constitution which may be seen at the bottom of the drawing paper is not illustrated. Further, FIG. 6 shows a cross sectional view along a plane shown by C in FIG. 5(*a*).

As shown in FIG. 5(*b*) and FIG. 5(*c*), a display cell (also referred to as a discharging cell) is formed between both of substrates 1 and 2 on every set of the transparent electrodes 5*a* and 5*b*, and a discharging space 3*f* is formed by both of the substrates 1, 2 and the barrier ribs 3*a*. A fluorescent film 14 is formed at the inside of the display cell. Further, discharge gas is sealed in the space 3*f* in the cell. In the display panel, as shown in FIG. 6, the barrier ribs 3*a* are in the form of parallel rods, and the discharging space 3*f* of the cell is continuous laterally (or longitudinally) and is not partitioned by the barrier ribs 3*a*.

When an AC voltage is applied between the electrodes 5, of the front substrate 1 and the address electrodes 9 formed to the back substrate 2, auxiliary discharging is generated in each of the cells 3*f* formed by the front substrate 1, the back substrate 2 and the barrier rib 3*a*. When AC voltage is applied between the parallel electrodes 5*a*, 6*a* and the electrodes 5*b*, 6*b* formed to the front substrate 1 on each of the cells by utilizing the auxiliary discharging, main discharge is generated. Ultraviolet rays caused by the main discharging causes the fluorescent body 14 coated in the cell to emit light. The display by the display panel is conducted by light from the fluorescent body 14 observed through the front substrate 1.

An example of the gas discharging type display device shown in FIGS. 4–6 is described in Flat Panel Display (1994 (edited by Nikkei Microdevice, 1993), page 198–201).

As a method of manufacturing such a gas discharging type color display panel, the method explained below is known.

At first, a pair of transparent substrates are provided. As the substrate used for the gas discharging color display panel, a soda glass (soda lime glass) plate having a strain point at about 450° C. is generally used.

After printing an electrode paste to a predetermined pattern by a thick film printing method to one of the glass substrates (back substrate) and drying the paste at 100°–150° C., it is baked at 500°–600° C. Then, for forming a display cell as a picture element, a barrier rib-forming paste is printed in a predetermined pattern by a thick film printing method on the surface of the back electrode formed with the electrode pattern and dried at 100°–150° C. This forms a number of cells arranged in a matrix on the back substrate. A thick film thickness (for example, 160 to 200 $\mu$m) is required for the barrier rib in order to ensure a sufficient discharging space and such a thickness can not be obtained by use of the thick film printing method only once. Accordingly, printing and drying of the barrier rib-forming paste are carried out a plurality of times. To the interior of the cells formed by the barrier ribs, red, blue and green pastes for the fluorescent body are printed in a predetermined pattern by a thick film printing method and dried at 100° to 150° C. followed by sintering at 500°–600° C. Thus, a back electrode formed with a display cell can be obtained.

A vapor deposition film of a transparent conductor, for example, ITO (indium tin oxide) is formed on the other of the glass substrates (front substrate glass plate), which is patterned to form a number of electrode patterns in parallel with each other such that two electrodes parallel with the row of the cells are disposed on every cells. Then, a buss electrode is formed to each of the electrode portions of the pattern for reducing the resistivity of the electrode. After printing a dielectric paste in a predetermined pattern on the surface formed with the electrodes by a thick film printing method and drying the same at 100°–150° C., it is sintered at 500°–600° C. Further, an MgO film is formed to the surface of the resultant dielectric film by an EB (electron beam) vapor deposition method. Thus, a front substrate formed with transparent electrodes can be obtained.

Then, the front substrate and the back substrate are aligned with the surface of the front substrate formed with the MgO film and the surface of the back substrate formed with the cell being opposed to each other, and edge portions of both of the substrates are covered with lead glass for sealing, and heated at about 450° C. to effect sealing between both of the substrates. Then, air in the gap surrounded with both of the substrates and the sealed portion is evacuated from an evacuation pipe and a discharge gas is entered into the gap by way of the evacuation pipe. Finally, the evacuation pipe is chipped off to seal the discharge gas. With the procedures described above, the gas discharging type color display panel is prepared.

In the foregoing explanation, although the barrier ribs are formed to the back substrate, the barrier ribs may be formed on the front substrate or formed on both of the front substrate and the back substrate depending on the design of the display panel. Further, the electrode or the MgO film may sometimes be formed by a thick film printing method.

The method of manufacturing the display panel described above has a merit capable of manufacturing a display panel relatively easily since the barrier ribs, electrodes, the fluorescent body, etc. are formed by the thick film printing method.

As described above, in the gas discharging type display panel of the prior art, since auxiliary discharging and main discharging are conducted in an identical discharging space, light emission is caused by the auxiliary discharging also in an area where the main discharging is not conducted, so as to bring about a problem that the display panel is not capable of obtaining a sufficient contrast. If sufficient contrast is not obtained, high speed time divisional control has to be applied by a complicated driving method in order to obtain sufficient gradation for full color display. Thus, it is desirable to obtain a sufficient contrast by the structure of the gas discharging display panel.

Further, the thickness of the barrier rib has to be made as large as from 160 to 200 $\mu$m in order to ensure a sufficient discharging space, but such thickness can not be obtained by only one time of the thick film printing so that the manufacturing method adopted so far provides the required thickness by repeating printing and drying of the paste for several times. However, with such a procedure, the manufacturing step is made lengthy and since alignment is conducted on every printing, the yield is worsened.

In view of the above, it is considered to dispose a partition wall substrate as an integral part of a partition wall having penetration apertures as a discharging conduction path and barrier ribs and put the partition wall substrate between the front substrate and the back substrate. If the space in the display cell is separated by the partition wall into an auxiliary discharging space and a main discharging space, since light caused by the auxiliary discharging can be shielded, the contrast is increased. Further, if the partition wall substrate having the partition wall and the barrier ribs is manufactured by integral shaping, for example, by a sand blasting method of a glass or ceramic plate as an insulator, since this can be handled as one part, no accurate alignment is required as in the case of forming the barrier ribs with the thick film printing.

However, in the methods described above, since the substrate such as of ceramics requiring difficult fabrication has to be fabricated into a complex shape, the number of steps is increased to increase the cost.

SUMMARY OF THE INVENTION

It is therefore an object of the present invention to provide an inexpensive gas discharging type display panel having high accuracy and a good yield, and having sufficient discharging space, as well as a manufacturing method thereof.

For attaining the foregoing object, in the present invention, the auxiliary discharging space and the main discharging space in the cell are separated by a partition wall provided in a partition wall substrate, a metal material of excellent workability is used for the material of the partition wall substrate and formed by providing a covering of insulation material thereon.

According to the present invention, the problem of the contrast can be overcome by shielding the light caused by the auxiliary discharging by the partition wall. Further, the problem of the cost for the partition wall substrate can be overcome by using a metal material at a reduced cost and having good workability. This is because the metal material can be formed easily and at a reduced cost into a partition wall substrate of a complex shape, for example, by an etching method, a laser fabrication method, a shaping method and a machining method.

However, if a metal material is used for the partition wall substrate, electric charges can not be accumulated upon discharging because of the high conductivity of the metal material, and it may possibly bring about erroneous discharging in other cells. In view of the above, in the present invention, the partition wall substrate is electrically insulated by covering the metal material with an insulation material.

It is necessary that the insulation material for covering the exposed portion of the partition wall substrate should be free from defects such as pores. Thus, it is desirable, as the material of the partition wall substrate, to use a metal material capable of forming an oxide film as an insulator, for example, at least one of metals of Al, Ti, Fe, Ta, W, Mo, Cu, Mg, Ni, Co, and Cr or an alloy containing the metal.

The method of forming the insulation film on the metal surface can include a method of forming an insulation oxide film by oxidizing the metal itself, or a method of coating the surface of a metal or the surface of an oxide film thereof with a gel obtained by hydrolysis of an organic metal compound (particularly, organic metal oxide or organic metal alkoxide), or an aqueous solution of an alkali silicate and then applying a heat treatment to form an inorganic oxide film. A partition wall substrate of excellent insulation property can be obtained by forming the insulation film by these methods.

In a case of using the gel or the aqueous solution, the surface of the partition wall substrate is covered by utilization of a dipping method, a spraying method or an electrodeposition method. Since the method of using the gel or the aqueous solution can form a dense insulation film at a low temperature, it is desirable for obtaining a partition wall substrate of excellent insulation property.

In the present invention, a display panel is constituted by forming a display cell by partitioning cells as picture elements from each other by barrier ribs and forming a partition wall for shielding light caused by auxiliary discharging (discharging space separation partition wall) in each of the cells. The partition wall is preferably arranged in parallel with the front substrate and the back substrate.

In the display panel according to the present invention, auxiliary discharging is generated by applying a voltage to the auxiliary discharging electrode disposed on the back electrode, in which charged particles or excited atoms formed by the auxiliary discharging intrude through a conduction path to the main discharging space to facilitate discharging in the main discharging space. That is, in the present invention, the starting voltage for the main discharging is lowered and stabilized by supplying charged particles or excited atoms having an effect of a pilot flame by way of the conduction path to the main discharging space.

When an AC voltage is applied between two parallel electrodes formed on the front substrate in a state where the charged particles or excited atoms are supplied in the main discharging space, discharging is formed in the main discharging space and ultraviolet rays are generated causing the fluorescent body to emit light. Display is conducted by observation of the light emission from the fluorescent body through the front substrate. In the present invention, the auxiliary discharging space and the main discharging space are separated and the fluorescent layer is not formed in the auxiliary discharging space. Accordingly, since light is not emitted by the fluorescent light in the auxiliary discharging and the light of gas discharge caused by the auxiliary discharging is shielded by the partition wall, only the light emission caused by the main discharging is observed from the outside of the front substrate. Accordingly, in the present invention, a sufficient contract can be obtained for the displayed images.

In addition, in the present invention, since the main discharging takes place between adjacent electrodes provided on the front substrate, the driving voltage can be lowered by making the electrode distance narrower. Lowering of the driving voltage not only can save the consumption power, but also can reduce damage to the protective film due to sputtering caused by discharging and, accordingly, also provides an effect of increasing the working life of the display panel.

For maintaining the discharge starting voltage low and stabilizing discharging, it is effective to cover the electrode with a dielectric material to provide a memory function and, further, to cover the insulator with a material such as MgO, CaO, or SrO to enhance the performance of emitting secondary electrons to the discharging space.

Further, in order to protect the electric layer, it is preferred to form a protective film such as an MgO film, a CaO film, or an SrO film on the surface of the front substrate and the back substrate facing the discharging space. This is because the protective film suffers from less damages by the sputtering accompanying discharging because of low sputtering rate, and thereby is capable of increasing the working life of the display panel. For the protective film on the side of the front substrate, a transparent material such as an MgO film is preferably used.

In the present invention, at least a portion of the barrier rib for defining each of the cells is fabricated as one part, that is, as a partition substrate and a display panel is manufactured by assembling the partition wall substrate, the front substrate and the back substrate. With such a constitution, since it is not required to repeat printing a plurality of times by a thick film printing method or the like for the formation of a thick ceramic film for the partition wall and the barrier rib, the positional accuracy is improved and the production yield is also improved. The partition wall substrate preferably comprises barrier ribs on the side of the front substrate, a discharging space separation partition wall, and barrier ribs for the back substrate, but it may comprise only a portion thereof, for example, barrier ribs on the side of the front substrate and discharging space separation partition walls.

Further, in the present invention, the fluorescent layer is preferably formed on the lateral surface of the barrier ribs on the side of the front substrate constituting the inner wall of the main discharging space and on the surface of the front substrate of the discharging space separation partition wall. With such a constitution, since the area of the fluorescent layer can be increased, the light emission efficiency caused by discharging can be improved.

If the light emitted from the fluorescent body permeates the barrier ribs between each of the cells and partition walls in parallel therewith formed between the front substrate and the back substrate and leaks to adjacent cells, undesirable color mixing is caused in the case of the color display panel. Since the barrier rib and the discharging space separation partition wall used in the gas discharging type display panel according to the present invention comprises a metal material covered with an insulator, it is not transparent and hinders the light emitted by electric discharging from leaking into adjacent cells, so that it has an effect of preventing color mixing. Further, if the insulator is transparent, since the light emitted by the discharge is reflected on the surface of the metal material for the partition substrate, an effect of improving the emission efficiency can also be obtained.

Further, if the partition wall and the barrier rib are formed with metal, they are less subject to breaking as compared with those formed by glass or ceramic, and the thickness of the partition wall and the barrier rib can be reduced. Further, since the fabricability is excellent, the height of the barrier rib on the side of the front substrate can be increased easily. Therefore, in accordance with the present invention, since the discharging space is increased, the coating amount of the fluorescent body can be increased to improve the luminosity. Further, since the supply of the charged particles and the like from the auxiliary discharging space to the main discharging space is facilitated, the address voltage can be lowered. Further, since the cell pitch can be narrowed, a panel with high accuracy can be manufactured.

For the metal material used for manufacturing the partition wall substrate in the present invention, any material may be used so long as it gives no undesired effect on vacuum discharging. It is preferred to use a material having satisfactory machinability, etching property, laser fabricability or moldability.

Since the machining method is applied by using a drill or a bit, it is difficult to fabricate glass or ceramic by this method. However, the metal material can be fabricated relatively simply by this method. According to this method, since the fabrication size can be controlled by the size of the tool, the conduction path or the like can be fabricated simply in an identical shape.

In the etching method, patterning is applied by using a photo-process. Since dimensional accuracy for exposure and development is high in this method, fabrication with high accuracy is possible. While the laser fabrication method undergoes the effect, for example, of moving accuracy of a table on which a work is placed, distribution of energy of the laser beam or the like, fabrication is possible at an accuracy comparable with that of the etching method.

In the shaping method, the substrate is shaped by shaping the substrate under pressure in a mold, which is excellent for mass productivity. In a case of fabrication into a structure having repeating cells of an identical size as in the partition wall substrate of the present invention, a shaping method of excellent mass productivity is particularly suitable. The shaping method includes a press fabrication method and a roll fabrication method. In the press fabrication method, shaping is conducted by putting the substrate between upper and lower molds and applying a pressure. Heat may be applied sometimes for improving the moldability. In the roll fabrication method, shaping is applied by passing a substrate between upper and lower rolls formed with a shape.

The shaping product shaped into the form of the partition wall and the barrier rib by the method as described above is coated with an insulator for insuring the insulation property. For the coating with the insulator, a layer of an insulation material such as glass may be formed on the surface. However, a method of covering the metal material by heating in air or the like thereby forming an insulation oxide film is a convenient and inexpensive method and hence is excellent. In view of the above, for a substrate for forming the shaping product, it is desirable to use a metal material capable of forming an oxide film as an insulator densely and it is desirable to use at least one of the metals, for example, of Al, Ti, Fe, Ta, W, Mo, Cu, Mg, Ni, Co and Cr, or an alloy containing the metal.

While the insulation property can be ensured only with the oxide film described above, it is desirable to further form an insulation film with an insulation material on the oxide film. The insulation film by the insulation material may be formed on the surface of the fluorescent body so long as the film allows ultraviolet rays or a light at a predetermined wavelength (display color) to permeate therethrough. In such a constitution, since it also acts as the protective film for a fluorescent body, the working life of the fluorescent body can be increased. In a case of forming the insulation film on the surface of the fluorescent layer, it may be formed only on the surface of the fluorescent layer or may be formed entirely or partially of the surface of the partition wall substrate containing the fluorescent layer.

The insulation layer formed on the surface of the metal shaping product, the surface of the metal oxide layer or the surface of the fluorescent layer of the partition wall substrate is preferably an inorganic oxide, for example, glass which is particularly preferably transparent. The inorganic oxide can include an inorganic oxide obtained by heating a gel formed by hydrolysis, for example, of an organic metal compound (hereinafter referred to as an organic metal gel) or an aqueous solution of an alkali silicate (hereinafter referred to as water glass).

The organic metal gel comprises ceramics dispersed at a molecular level and an inorganic material can be obtained by removing a solvent such as water or alcohol. However, it is desirable to apply a sufficient heat treatment in order to thoroughly remove adsorbed water or alcohol so that gas is not generated during discharging and to obtain an insulator layer which is homogeneous and strong. However, since the gel comprises ceramics at the molecular level, the sintering temperature is low and can be heat-treated sufficiently at a temperature lower than 450° C. which is a strain point for soda glass material.

For obtaining a homogeneous and strong insulator layers it is desirable to apply heat treatment at least at 50° C. or higher. If the temperature for the heat treatment is low, although a solvent such as water or alcohol can be removed, hydroxy groups, etc. adsorbed on the surface of the insulator formed can not sometimes be eliminated completely, so that steams or alcohols may sometimes be released when the panel is evacuated after assembling and, further, introduced with gas after sealing, which may possibly give an effect on discharging. In addition, if the temperature for the heat treatment approaches 450° C. as the strain point of the soda glass material, glass is liable to be deformed though the strain point is not exceeded. Moreover, since a glass plate of a large area used for a gas discharging type display panel is particularly liable to be deformed even by its own weight, it is required not to elevate temperature as much as possible. Then, the temperature of the heat treatment for the organic metal gel in the present invention is desirably higher than 100° C. and lower than 400° C.

The organic metal gel used in the present invention is obtained, for example, by hydrolyzing a solution of an organic metal compound such as of Si, Ti, Al or Zr (aqueous solution or alcohol solution) at or near the normal temperature. A polycondensating reaction proceeds in the reaction solution along with proceeding of hydrolysis to form a sol and, when the reaction proceeds further, a gel used in the present invention is obtained.

The example of the organic metal compound used herein can include a metal alkoxide represented by the general formula M(OR1)n. In this case, M represents a metal atom (including semi metal) including, for example, Si, Ti, Al and Zr. R1 represents an organic group for which an alkyl group of 1 to 5 carbon atoms is preferred. A symbol n is a positive integer defined by the valency of M and is usually from 1 to 4. The metal alkoxide or hydrolysis product thereof is changed into a metal oxide by a heat treatment.

The metal alkoxide usable in the present invention can include, for example, tetra(n-butyl) silicate: Si(OC4H9)4, tri(sec-butoxyl) aluminum: Al(OC4H9)3, tetra(n-propyl) titanate; Ti(OC3H7)4, tetra(n-butyl) zirconate: Zr(OC4H9)4 and trimethyl borate: B(OCH3)3.

The metal alkoxide can be obtained easily with high purity, for example, by using a metal chloride as the raw material for synthesis and purifying the chloride by a usual purification method such as distillation and recrystallization. Further, the metal alkoxide can be prepared for almost of metals and they are usually liquid at a normal temperature. Then, raw material gel for the glass or ceramic having a desired composition can be prepared easily by mixing a plurality kinds of the metal alkoxide and hydrolyzing them. Table 1 shows examples of the compositions for the insulators capable of being obtained from the organic metal gels.

TABLE 13

| No. | $SiO_2$ | $Al_2O_3$ | $TiO_2$ | $ZrO_2$ | $B2O_3$ |
|---|---|---|---|---|---|
| 1 | 100 | | | | |
| 2 | 37 | 63 | | | |
| 3 | 42.9 | | 57.1 | | |
| 4 | 54 | 46 | | | |
| 5 | 39.6 | 33.7 | 26.7 | | |
| 6 | 38.5 | 32.8 | | 28.7 | |
| 7 | 32.6 | 29.4 | 17.1 | 18.4 | 2.5 |
| 8 | 32.8 | | | 67.2 | |
| 9 | 22.7 | 77.3 | | | |
| 10 | 23.6 | 40.1 | 36.3 | | |
| 11 | 84 | 13 | | | |
| 12 | 22.1 | 37.7 | | 40.2 | |

Further, water glass as one of the insulation materials provided in accordance with the present invention is a concentrated aqueous solution of an alkali silicate represented by R22O, nSiO2 (the amount of water is 70 to 90% by weight based on the entire amount). In this case, R2 is at least one of sodium, potassium, lithium and rubidium, with potassium being particularly preferred. Further, n is 4–6, and the polymerization degree of the resultant glass is insufficient liable to absorb moisture if n is less than 4, whereas the hydrolyzing rate is slow if n is greater than 6. Compositional examples of the insulation materials obtained from water glass are shown in Table 2.

TABLE 2

| No. | $SiO_2$ | $K_2O$ | $Li_2O$ | $Na_2O$ | $Rb_2O$ |
|---|---|---|---|---|---|
| 1 | 79.28 | 20.72 | | | |
| 2 | 76.13 | 23.87 | | | |
| 3 | 71.84 | 28.16 | | | |
| 4 | 92.35 | | 7.65 | | |
| 5 | 90.95 | | 9.05 | | |
| 6 | 85.33 | | | 14.67 | |
| 7 | 82.95 | | | 17.05 | |
| 8 | 65.86 | | | | 34.14 |
| 9 | 61.66 | | | | 38.34 |
| 10 | 81.09 | 12.71 | 2.02 | 4.18 | |
| 11 | 82.19 | 10.74 | | 7.07 | |
| 12 | 79.38 | 12.44 | | 8.18 | |

For forming the insulation layer, in addition to the method of using the organic metal gel or water glass as described above, a sputtering method, a chemical gas phase reaction method or a thick film printing method, etc. can also be used.

DESCRIPTION OF THE PREFERRED EMBODIMENTS

Figure 1A:
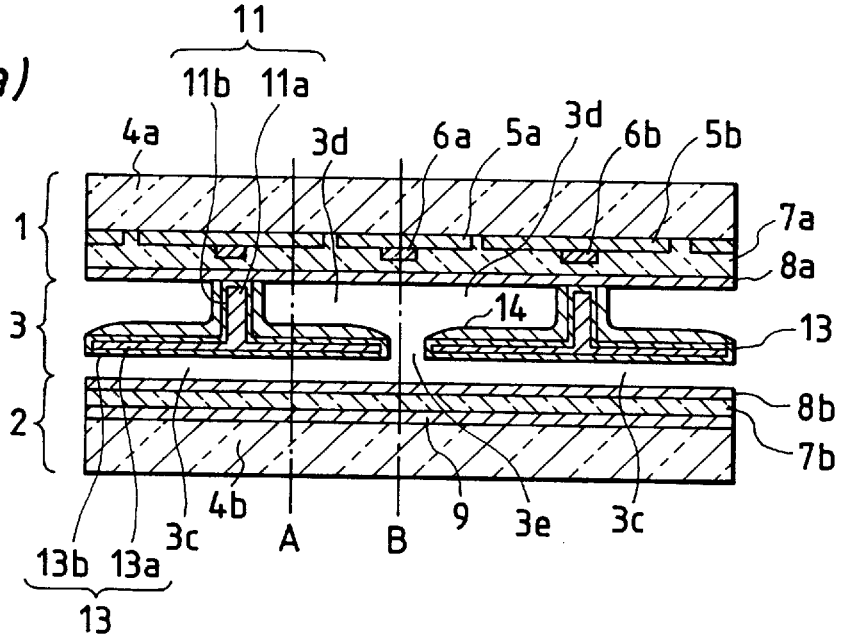
FIGS. 1(*a*)–(*c*) show cross sectional views illustrating a structure of a gas discharging type color display panel of Example 1.

Examples of gas discharging type color display panels according to the present invention will be explained specifically referring to the drawings. Materials, thickness, temperature, time and apparatus used referred to in the subsequent explanation show only one mode of practice and the present invention is not restricted to the examples.

EXAMPLE 1

Figure 1B:
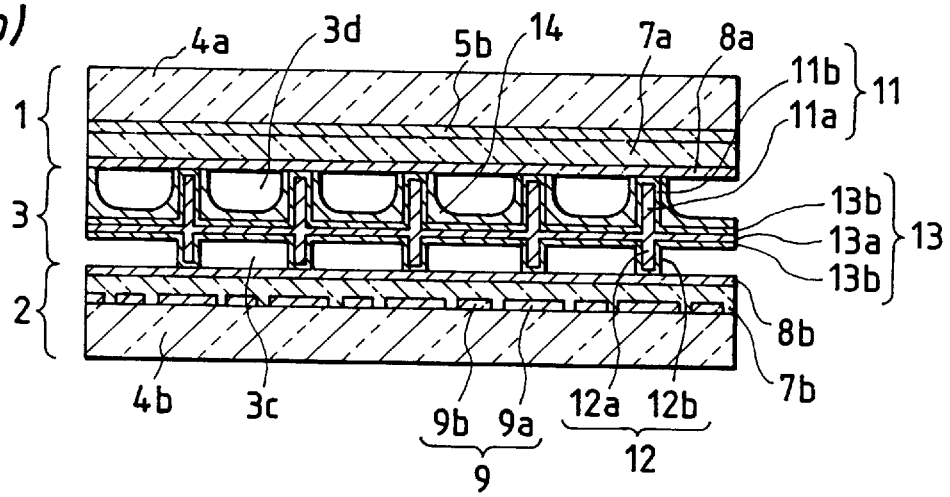
Figure 1C:
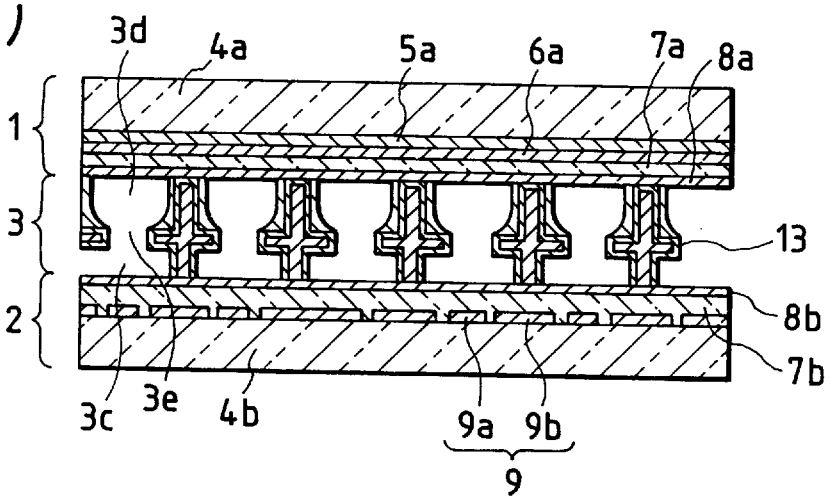
Figure 7A:
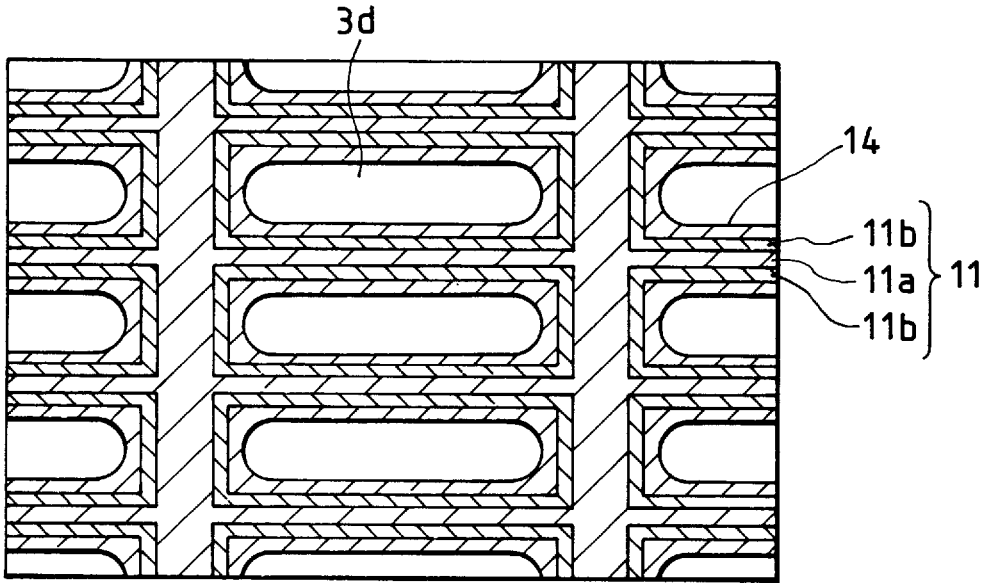
FIGS. 7(*a*) and 7(*b*) show cross sectional views illustrating the structure of a barrier rib in a gas discharging type color display,panel of Example 1.
Figure 7B:
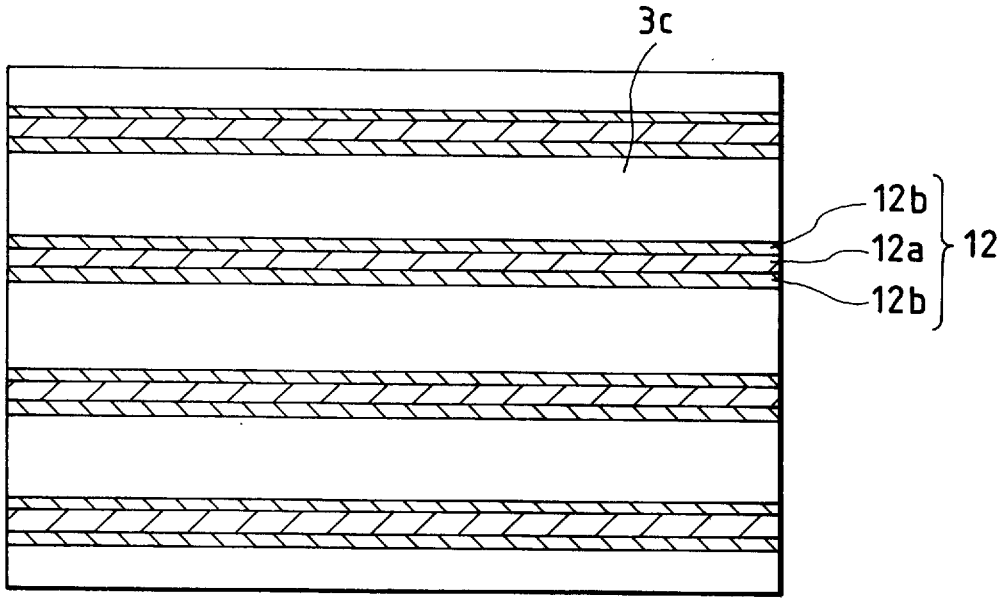

FIGS. 1(*a*)–1(*c*) and FIGS. 7(*a*) and 7(*b*) show cross sections of a gas discharging type color display panel manufactured by this example. The gas discharging type color display panel of this embodiment, as shown in FIG. 1(*a*)–(*c*), comprises a front substrate 1, a back substrate 2, and a partition wall substrate 3 for partitioning a gap therebetween to form cells as picture elements. A gas mixture of He and Xe (Xe content: 5 vol %) is sealed in a gap between the front substrate 1 and the back substrate 2.

The front substrate 1 has a soda glass plate 4*a*, ITO electrodes 5*a*, 5*b* formed on the surface thereof and extended in a direction perpendicular to the plane of FIG. 1, buss electrodes 6*a*, 6*b* formed on the surface of the ITO electrodes 5*a*, 5*b*, a dielectric layer 7*a* formed on the surface of the soda glass plate 4a so as to cover the ITO electrodes 5*a*, 5*b* and the buss electrodes 6*a*, 6*b* and, further, a MgO film 8*a* formed on the surface of the dielectric layer 7*a*. The electrode pattern formed with the ITO electrodes 5*a*, 5*b* and the buss electrodes 6*a*, 6*b* is patterned as a plurality of parallel linear patterns such that two parallel electrodes are disposed for each of the cells of cell rows arranged in one direction, among the cells arranged in a matrix. In the two main discharging electrodes on every cell row, the main discharging electrodes 5*a* and 6*a* are disposed on a conduction path at the center of the cell row, while the main discharging electrodes 5*b*, 6*b* are disposed across two cell rows, as shown in FIG. 1(*a*).

The ITO electrodes 5*a*, 5*b* are transparent electrodes. However, the ITO electrodes 5*a*, 5*b* have high wiring resistance value and if only one of the electrodes is used, the driving speed for the main discharging is slow. In the display panel of this embodiment, the buss electrodes 6*a*, 6*b* made of metal and extending in parallel with linear lines formed by the ITO electrodes 5*a*, 5*b* are disposed to lower the wiring resistance value of the electrodes on the front substrate 1. However, since the buss electrodes 6*a*, 6*b* are not transparent, the width is desirably as narrow as possible. This is for reducing the amount of light emitted from the fluorescent body 14 and shielded by the buss electrodes 6*a*, 6*b*.

The back substrate 2 comprises a soda glass plate 4*b*, address electrode 9 formed on the surface thereof an including adjacent address electrodes 9*a*, 9*b* as shown in FIGS. 1(*b*) and 1(*c*), the dielectric layer 7*b* formed on the surface of the first address electrode 9 and an MgO film 8*b* formed so as to cover the surface of the dielectric layer 7*b*. The address electrode 9 is patterned as a plurality of parallel linear patterns such that three electrodes extend in parallel with each two rows of cells in the cell row and orthogonal to the extending direction of the ITO electrodes 5*a*, 5*b*. One of the three address electrodes 9 at the center is disposed across two cell rows, as shown in FIGS. 1(*b*) and 1(*c*).

Since the MgO films 8*a*, 8*b* formed on the front substrate 1 and the back substrate 2 have low sputtering rate and excellent sputtering resistance, they can suppress damage by sputtering caused by discharging and act as protection films for the dielectric layers 7*a*, 7*b*. The MgO films 8*a*, 8*b* are effective for preventing discharge sputtering and making the working life of the display panel longer. Further, since the MgO films 8*a*, 8*b* are transparent, they easily permeate the light emitted from the fluorescent body 14 and are suitable to use for the display panel.

FIG. 1(*a*) is a cross sectional view showing the display panel cut along a plane in parallel with the address electrode 9 and vertical to the surface of the substrates 1, 2. Further, FIG. 1(*b*) is a cross sectional view at a position A in FIG. 1(*a*) and the cutting plane is vertical to the address electrode 9 and vertical to the surface of the substrates 1, 2. FIG. 1(*c*) is a cross sectional view at a position B in FIG. 1(*a*) and the cutting plane is vertical to the address electrode 9 and vertical to the surface of the substrates 1, 2.

The partition wall substrate 3 comprises barrier ribs 11, 12 in contact with the MgO film 8*a* of the front substrate 1 and the MgO film 8*b* of the back substrate 2, a partition wall 13 in parallel with the front substrate and the back substrate, and a fluorescent layer 14 formed on the lateral side of the barrier rib 11 on the side of the front substrate and the surface of the partition wall 13 on the side of the front substrate. The barrier ribs 11, 12 and the partition wall 13 are shaped integrally and comprise metal shaping members 11*a*, 12*a*, 13*a* covered with insulation layers 11*b*, 12*b*, 13*b*.

The fluorescent layer 14 is a coating film comprising a fluorescent body emitting green, blue or red light by radiation rays and, since the fluorescent layer 14 is provided for a wide range in this embodiment, the light emitting efficiency by the main discharging is good. A fluorescent body to be used that emits a specified color is determined on every cell such that the arrangement of color for the entire substrate forms a predetermined pattern.

The barrier ribs 11, 12 are in a lattice form for partitioning the gap between the substrates 1, 2 to form cells. FIG. 7(*a*) shows a cross sectional view of the barrier rib 11 on the side of the front substrate cut along a plane parallel with the surface and the rear face of the front substrate, while FIG. 7(*b*) shows a cross sectional view of the barrier rib 12 on the side of the back substrate cut along a plane in parallel with the surface and the rear face of the front substrate.

A cell formed with the front substrate 1, the back substrate 2 and the partition wall substrate 3 is separated by barrier ribs 11, 12 from adjacent cells. In this embodiment, the partition wall 13 is disposed horizontally to the glass plates 4*a*, 4*b*, but it is not necessary to be horizontal so long as it does not hinder the movement of charged particles, etc.

For the space in the cell, the space 3*c* between the partition wall 13 and the back substrate 2 is defined as a space for auxiliary discharging, while the space 3*d* between the partition wall 13 and the front substrate 1 is defined as a space for main discharging. The space 3*c* for the auxiliary discharging and the space 3*d* for the main discharging are in communication by the conductive path 3*e* formed between the end of the partition wall 13 and the barrier rib and representing an aperture in the partition wall. In the cell, a discharge gas is sealed as described previously.

In the gas discharging type color display panel of this embodiment, when an AC voltage is applied between two adjacent address electrodes 9*a*, 9*b* disposed to the back substrate 2, auxiliary discharging occurs in the auxiliary space 3*c* of the cell present above them by way of the dielectric layer 7*b*.

In the display panel of this embodiment, a voltage is applied to all of the main discharging electrodes 5*b* and 6*b* across two rows of the display cells. Then, when an AC voltage is applied to the main discharging electrodes 5*a*, 6*a* used exclusively for the cell to be displayed in a state where the auxiliary discharging is generated as described above, a charge pattern of the electrodes is introduced by way of the dielectric layer 7*a* to the surface of the MgO layer 8*a* and, since the effect of the auxiliary discharging prevails by way of the conductive path 3*e* to the main discharging space 3*d*, main discharging is caused between different charges on the surface of the MgO layer 8*a*. That is, the main discharging is caused between charges introduced by way of the dielectric layer 7*a* to the surface of the MgO layer 8*a* by the application of a voltage to the ITO electrode 5*a* disposed with the bus electrode 6*a* and charges introduced by way of the dielectric layer 7*a* to the surface of the MgO layer 8*a* by the application of a voltage to the ITO electrode 5*b* disposed with the buss electrode 6*b*. The main discharging does not occur in a cell in which a voltage is not applied to the non-common main discharging electrodes 5*a*, 5*b* or the cell in which auxiliary discharging is not generated.

This main discharging excites the gas in the discharging space (gas mixture of He and Xe), to generate radiation rays (ultraviolet rays), and the radiation rays excite the fluorescent body 14 to emit visible light. Images are formed on the display panel by selecting an electrode to which the voltage is applied, thereby generating the visible light in each of desired cells and emitting the visible light through the front substrate 1 to the outside.

As described above, in this embodiment, each of the cells is partitioned by the barrier rib 3*a*, and the space between the front substrate 1 and the back substrate 2 is partitioned by the partition wall 13, by which the auxiliary discharging is concealed from the fluorescent body 14 so that the radiation rays generated by the auxiliary discharging not hit on the fluorescent body 14. Therefore, in the display panel of this embodiment, even when the auxiliary discharging is generated by the addresses electrode 9 on the side of the back substrate 2, the light emitted by the auxiliary discharging is hindered by the partition wall 13, and the fluorescent body 14 is caused to emit light only by the main discharging, accordingly, the fluorescent body 14 does not emit light in the cell in which only the auxiliary discharging occurs but the main discharging does not occur (that is, a cell in which the voltage is applied to the address electrode 9 but the voltage is not applied to the buss electrodes 6*a*, 6*b*), and only the light emitted by the main discharging can be observed from the front substrate 1, so that sufficient contrast can be obtained.

A method of manufacturing a gas discharging type display panel of this embodiment is explained with reference to FIGS. 8(*a*)–8(*p*).

A: Manufacture of Front Substrate (1) Formation of Main Discharging Electrode

At first, a front substrate 1 is manufactured. A soda glass plate 4*a* of about 85 cm width, about 70 cm dense and about 2.8 mm thickness having ITO film 5*c* formed on one of the surface or rear face (FIG. 8(*a*)) is provided. A light sensitive resin composition is coated on the surface of the ITO film 5*c* in a dust proof chamber at a room temperature of 15° to 25° C., and a humidity of 60%, the coating film of the light sensitive resin composition being exposed to an exposure amount of 300–250 mJ/cm2 by way of a mask having a predetermined pattern by a super-high pressure mercury lamp at 3 kW (8 kW power), spray-developed by using an aqueous 0.2–0.5% solution of sodium carbonate under the condition at a developing temperature of 25° C. and at a pressure of 1.2 kg/cm2 for 105 sec, then neutralized with 0.1% diluted acid, washed with water and dried to form a resist film of a predetermined pattern. Then, after etching the exposed portion of the ITO film 5*c* by the etching solution, the resist film is peeled off with a peeling liquid. Thus, the ITO film 5*c* is patterned and ITO electrodes 5*a*, 5*b* are formed at a predetermined position (FIG. 8(*b*)).

Figures 8A, 8B, 8C, 8D, 8E, 8F, 8G, 8H, 8I, 8J, 8K, 8L, 8M, 8N, 8O, 8P:
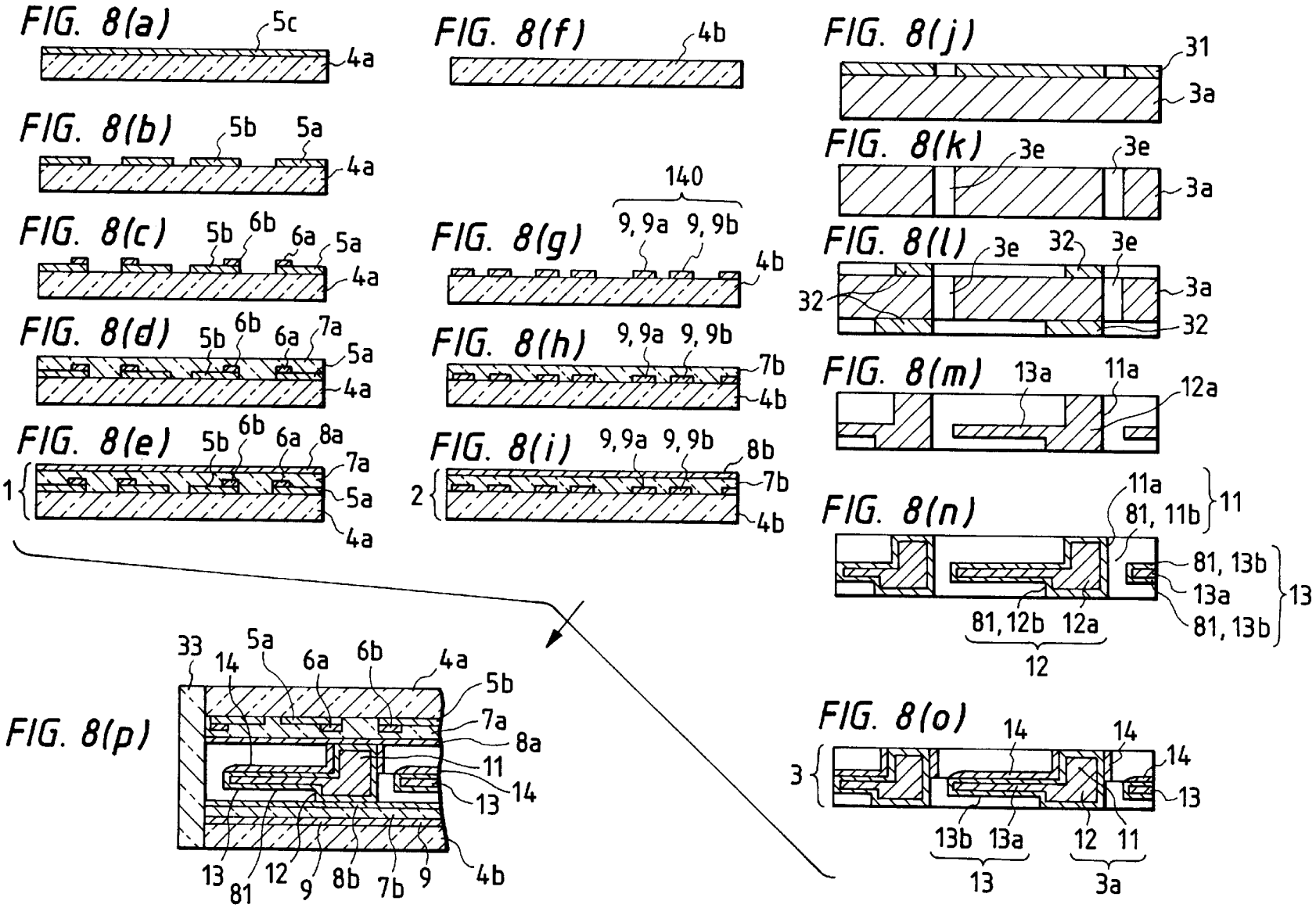
FIGS. 8(*a*)–8(*p*) are explanatory views illustrating steps for manufacturing a gas discharging type color display panel of Example 1.

In the same manner, after forming a resist film of a predetermined pattern on the resultant ITO electrodes 5*a*, 5*b*, buss electrodes 6*a*, 6*b* each of 0.05 mm width and 0.03 mm thickness are formed by an electroless plating method (FIG. 8(*c*)). Any metal having good conductivity may be used for the electrode material and copper is used in this embodiment. After the plating treatment, the resist film is peeled off by the peeling solution.

(2) Formation of Dielectric Layer

A hydrolysis type coating agent comprising Al, Si, O as the main ingredient (composition No. 11 in Table 1). In this embodiment, a gel obtained by hydrolysis at a normal temperature of an n-butanol solution containing tri(n-butoxyl) aluminum, tetra(n-butyl) silicate and tri(n-butoxyl) borane at a ratio of 84:13:3 (weight ratio) each being converted as a metal oxide) is coated by a blade method to the surface of the ITO electrodes 5*a*, 5*b*, bus electrodes 6*a*, 6*b* and the glass plate 4*a*, and heated at 50°–500° C. for 5 to 60 min, to form a transparent dielectric layer 7*a* of 0.003–0.01 mm thickness (FIG. 8(*d*)).

When the gas discharged in vacuum is analyzed for the product heated at 50°–80° C. for 60 min, water or gas of alcohol is detected. Further, in the product heated at 420°–500° C. for 10 min, warp is caused at about 0.15 mm to the soda glass plate 4*a*. The product heated at a temperature from 100° to 400° C. for 5 to 60 min is satisfactory releasing no gases in vacuum and causing no warp to the soda glass plate 4*a*. Then, in the subsequent step, a product heated at a temperature 100° to 400° C. for 5 to 60 min is used.

(3) Formation of Protective Film

A hydrolysis coating agent comprising MgO and O as the main ingredient (gel obtained by hydrolysis at a normal temperature of n-butanol solution containing di(n-butoxyl) magnesium) is spin-coated on the surface of the resultant dielectric layer 7*a*, and heated at a low temperature in the same manner as in (2) above at a temperature from 100° to 400° C. for 5 min to 60 min to form an MgO film 8*a* having 0.001 to 0.005 mm thickness (FIG. 8(*e*)). The dielectric layer 7*a* and the protective film 8*a* can be formed in the same manner by a spray method, a roll method, dipping method, a printing method or the like in addition to the method described above.

With the steps (1)–(3) described above, the front substrate 1 is obtained without heating to a temperature higher than the strain point (450° C.) of the soda glass plate 4*a*. In the steps described above, there is no dimensional change in the soda glass 4*a*.

B. Manufacture of Back Substrate (4) Formation of Auxiliary Discharging Electrode A method of manufacturing a back substrate 2 is explained. At first, a light sensitive resin composition is coated on a back substrate comprising soda glass plate 4*b* cleaned by using, for example, a neutral detergent (about 85 cm width, about 70 cm length, about 2.8 mm thickness) shown in FIG. 8(*f*), and the coating film of the light sensitive resin composition is exposed by way of a mask having a predetermined pattern by a super-high pressure mercury lamp at 3 kW (8 kW power) by an exposure amount of 200 to 250 mJ/cm2, spray-developed by using an aqueous 0.2–0.5% solution of sodium carbonate under the conditions at a developing temperature of 25° C. and at a pressure of 1.2 kg/cm2 for 105 sec, then neutralized with 1% diluted acid, washed with water and then dried to form a resist film of a predetermined pattern. Thus, a resist film having a predetermined pattern is formed. An address electrode 9 (9*a*, 9*b*) comprising copper having 0.1 mm width, and 0.003 mm thickness is formed by an electroless plating method to a portion of the glass plate 4*b* not covered with the resist film. After the plating treatment, the resist film is peeled off by a peeling solution (FIG. 8(*g*)). The pattern dimension and the thickness of the auxiliary discharging electrode may be determined based on the resistance value required for the auxiliary discharging electrode.

(5) Formation of Dielectric Layer and a Protective Layer

The same hydrolysis type coating agent as used in the step (2) described above is coated by a blade method or a spray method to the surface of the glass substrate 4*b* so as to cover the resultant auxiliary discharging electrode 9, and heated at a temperature of 100° to 400° C. for 1 to 60 min to form a dielectric layer 7*b* of 0.001 to 0.03 mm thickness (FIG. 8(*h*)). Further, a protective layer 8*b* comprising MgO is formed in the same manner as in the step (3) described above (FIG. 8(*i*)). The back substrate 2 is thus obtained. A chip pipe (not illustrated) is attached to the back substrate 2 for evacuation and gas introduction conducted after assembling the panel.

C. Manufacture of Partition Wall Substrate (6) Formation of Conduction path

A partition wall substrate 3 is manufactured as follows. At first, a light sensitive resin composition is coated on a metal aluminum plate 3*a* of about 85 cm width, about 65 cm length and about 0.5 mm thickness, the coating film of the light sensitive resin composition is exposed by way of a mask having a predetermined pattern by a super-high pressure mercury lamp at 3 kW (8 kW power) at an exposure amount of 200 to 250 mJ/cm2, spray-developed by using an aqueous 2–0.5% solution of sodium carbonate under the conditions at a developing temperature of 25° C. and at a pressure of 1.2 kg/cm2 for 105 sec, then neutralized with 0.1% diluted acid, washed with water and dried, to form a resist film of a predetermined pattern. A resist film 31 of a predetermined pattern is thus formed (FIG. 8(*j*)).

Next, a portion of the aluminum plate 3*a* not covered with the resist film 31 is etched, a through hole having a size at an opening portion of 0.1 mm×0.15 mm is formed as a conduction path 3*e* and then the resist film is peeled off by a peeling solution (FIG. 8(*h*)).

(7) Formation of Barrier Rib and Partition Wall

A light sensitive resin composition is coated again to both of the surface and the rear face of the metal aluminum plate 3*a* with a resist film 32 of a predetermined pattern being formed in the same manner as described above, and a portion not covered with the resist film 32 is removed to a predetermined depth by a both face etching method to form a recess constituting a main discharging space and an auxiliary discharging space. Thus, a molding product having barrier ribs 11 on the side of the substrate 1, the barrier ribs 12 on the side of the back substrate 2 and a partition wall 13 for separating the main discharging space and the auxiliary discharging space formed integrally is obtained (FIG. 8(*m*)).

(8) Formation of Insulation Film

The same hydrolysis type coating agent as used in step (2) is coated on the surface of the resultant molding product by a dipping method, and heated at a low temperature in the same manner as for the formation of the dielectric layer 7*a* at a temperature from 100° to 450° C. for 5 to 60 min to form insulation material 81 of 0.005 to 0.015 mm thickness. Thus, the insulation layer 13*a* for the partition wall 13 and the insulation layers 11*a*, 12*a* for the barriers 11, 12 are formed (FIG. 8(*n*)).

(9) Formation of Fluorescent Layer

Further, after spraying each of fluorescent bodies for green, blue and red from the side of the front substrate 1 by way of masks having predetermined patterns for green, blue and red, respectively, to the side of the front substrate of the part, they are dried at a temperature of 150° C. to 300° C. for 5 min to 60 min to form fluorescent layer 14 (FIG. 8(*o*)). If color display is not required, it may suffice to form a fluorescent layer of an identical color for the entire cell.

With the steps (6)–(9) described above, a partition wall substrate 3 as a part having the barrier rib 3*a*, partition wall 13 and the fluorescent layer 14 is obtained.

D. Assembling

(10) Assembling of Substrates 1–3

After aligning the substrates 1–3 obtained as described above and covering the periphery thereof by coating a sealing material (flit glass) by a dispenser, a heat treatment is applied at 300° C. to 400° C. to fix the sealing material 33. The display panel us assembled at a good accuracy with no distortion for the substrates 1–3 (FIG. 8(*p*)).

(11) Injection of Gas

Finally, the inside of the cell is evacuated by drawing air by way of a chip pipe (not illustrated) and a gas mixture comprising He-5% Xe is introduced till the gas pressure at the inside of the cell reached 300 Torr to 500 Torr (39.9 kPa–66.5 kPa) and then the chip pipe is heated to chip-off by local heating to obtain a gas discharging type color display panel having the same constitution as that shown in FIGS. 1(*a*)–1(*c*).

E. Result

With the steps (1)–(11) described above, a gas discharging type color display panel is manufactured at a reduced cost and with high accuracy, in which the gap between the front substrate 1 and the back substrate 2 is divided by the barrier rib 3*a* to form a plurality of cells, the inside for each of the cells is separated into the main discharging space 3*d* and the auxiliary discharging space 3*c* by the partition wall 13 for concealing the auxiliary discharging, and the main discharging space 3*d* is in communication with the auxiliary discharging space 3*c* by way of the conduction path 3*e*.

In the display panel of this embodiment, the thickness of the partition wall 13 is 0.1 mm, and the conduction path 3*e* is disposed at the center of the partition wall 13 in each of the cells. Further, the main discharging space 3*d* has a size of 0.33 mm length, 1.1 mm width and 0.3 mm height in FIG. 1(*a*), while the auxiliary discharging space 3*c* has a size of 0.33 mm length and 0.1 mm height in FIG. 1(*a*).

In the display panel of this embodiment, since light emission by the auxiliary discharging is shielded by the partition wall 13 and only the emission by the main discharging is observed, a sufficient contrast (more than 400:1) can be obtained between the cell causing main discharging and a cell not causing main discharging.

EXAMPLE 2

While the barrier rib 11 on the side of the front substrate and the barrier rib 12 on the side of the back substrate were collectively formed by the both-face etching method in Example 1, the barrier rib 12 on the side of the back substrate is formed on the protective film 8*b* of the back substrate 2 in this embodiment. The method of manufacturing the display panel in this embodiment is identical with that in Example 1 except that the method of forming the barrier rib 12 is different. Then, only the steps different from Example 1 are explained here while saving explanation for the remaining steps.

Figure 2A:
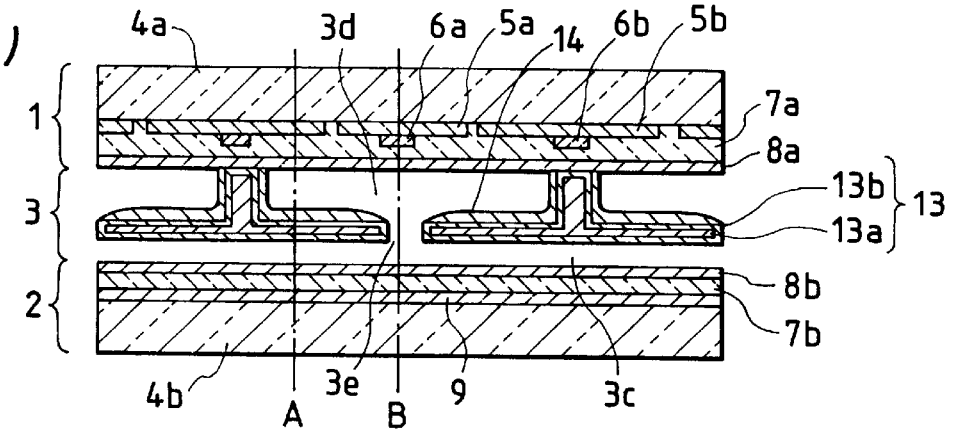
FIGS. 2(*a*)–2(*c*) show cross sectional views illustrating a structure of a gas discharging type color display panel of Example 2.
Figure 2B:
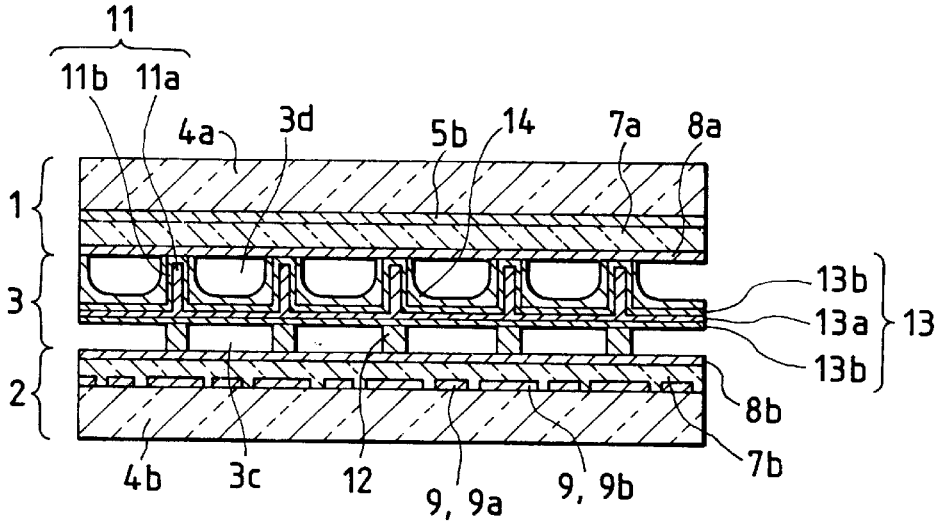
Figure 2C:
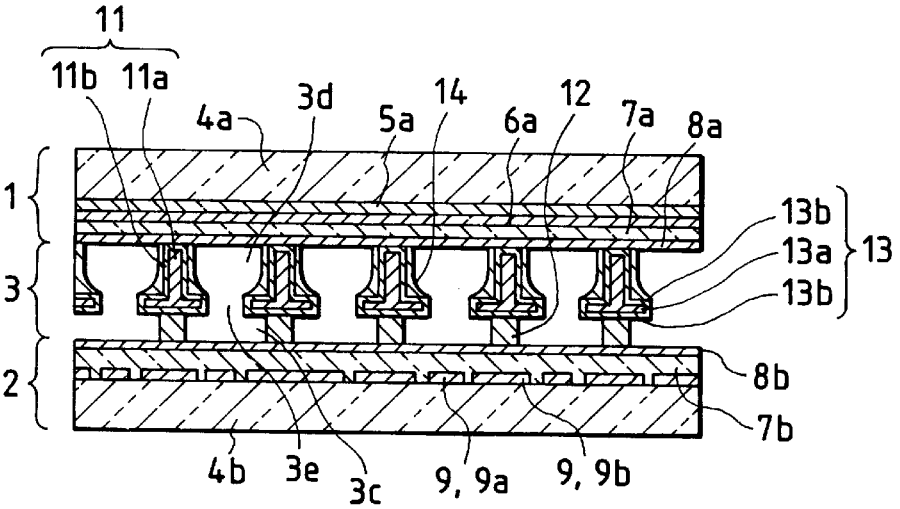
Figure 9A:
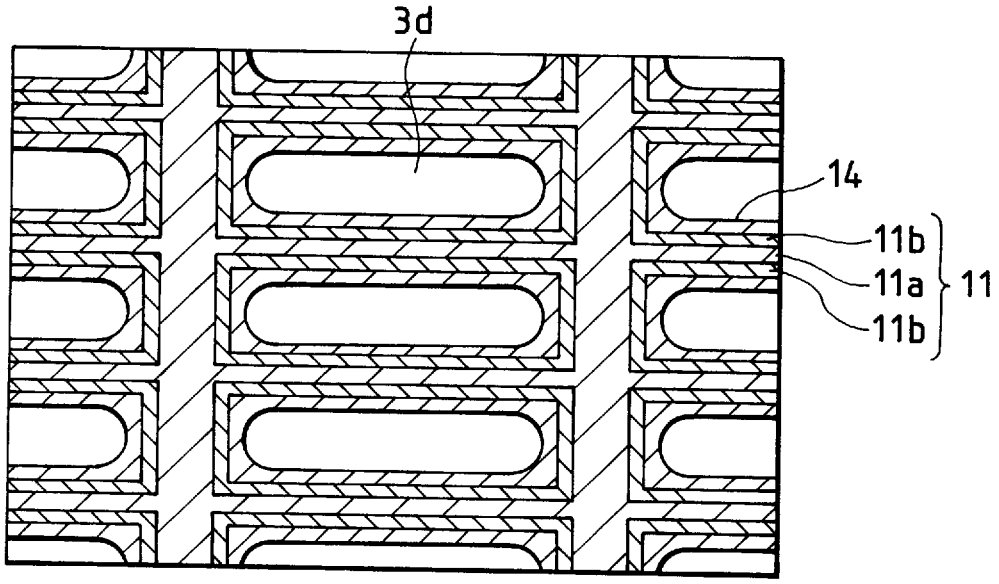
FIGS. 9(*a*) and 9(*b*) are enlarged cross sectional views illustrating the structure of a barrier rib in a gas discharging type color display panel of Example 2.
Figure 9B:
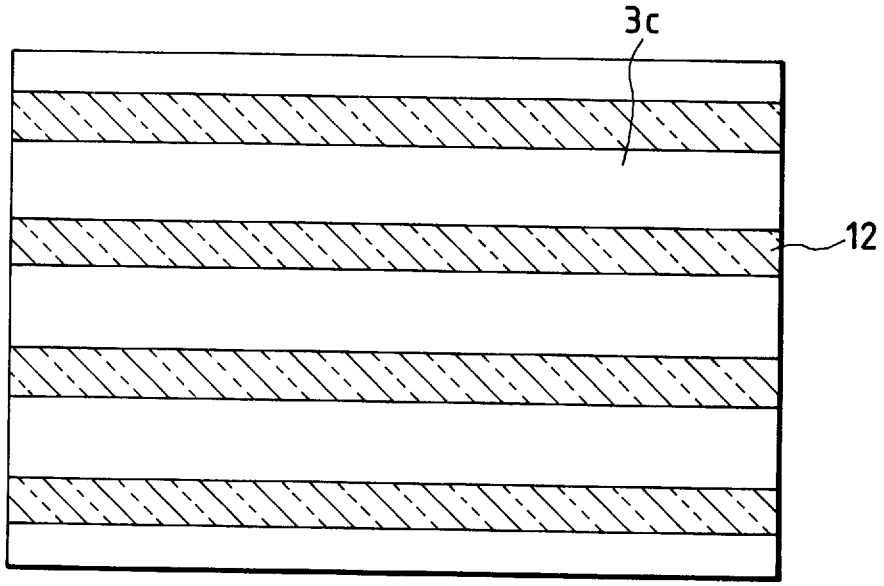

The cross sectional views of the display panel manufactured in this embodiment is shown in FIGS. 2(*a*)–(*c*). Like that in FIG. 1(*a*), FIG. 2(*a*) is a cross sectional view for a portion of a display panel in this embodiment cut along a plane parallel with the address electrode 9 and vertical to the surface of the substrates 1, 2. Further, FIG. 2(*b*) is a cross sectional view at position A in FIG. 2(*a*) and the cutting plane is vertical to the address electrode 9 and vertical to the surface of the substrates 1, 2. FIG. 2(*c*) is a cross sectional view at a position B in FIG. 2(*a*) and the cutting plane is vertical to the address electrode 9 and vertical to the surface of the substrate 1, 2. FIG. 9(*a*) and (*b*) show cross sections cutting along a plane parallel with the main surface of the front substrate 1 (a surface exposed to the outside in each of the surface and the rear face). The size of the discharging space of the display panel manufactured by this embodiment is identical with that in Example 1.

A. Manufacture of Back Substrate

A hydrolysis type coating agent used in the step (2) of Example 1, mixed with a spherical alumina particle and potassium titanate fiber as a binder (mixing ratio of the binder: 80 wt %) is coated at a predetermined position on the protective film 8*b* of the back substrate 2 manufactured in the same manner as in steps (4) and (5) of Example 1 by a blade method or a printing method and heated in the same manner as in the step (2), to form a barrier rib 12 of 0.1 to 0.2 mm thickness.

B. Manufacture of Partition Wall Substrate

Partition wall substrate 3 is manufactured in the same manner as in Example 1 using a metal aluminum plate 3*a* of about 85 cm width, about 65 cm length and 0.4 mm thickness in this embodiment as a substrate 3*a* to be etched. However, the surface of the aluminum plate 3*a* on the side of the back substrate is covered with a resist film 32 and only the surface on the side of the front substrate is etched.

C. Result

Finally, when the front substrate 1, the partition wall substrate 3 not formed with the barrier rib 12 on the side of the back substrate 12, and the back substrate 2 formed with the barrier rib 12 on the side of the back substrate manufactured in the same manner as in Example 1 are aligned and laminated in this order, the periphery is sealed in the same manner as in Example 1, He-5% Xe gas is sealed, and then the chip pipe is chipped off to obtain a gas discharging type color display panel, a display panel of good contrast for color emission is obtained like that in Example 1.

EXAMPLE 3

In this example, a display panel is manufactured in the same manner as in Example 2 except for forming the barrier rib on the side of the front substrate with ceramics. The method of manufacturing the display panel in this embodiment is identical with that in Example 2 except that the method of forming the barrier rib 11 is different. Then, only the steps different from Example 2 are explained here while saving explanation for the remaining steps.

Figure 3A:
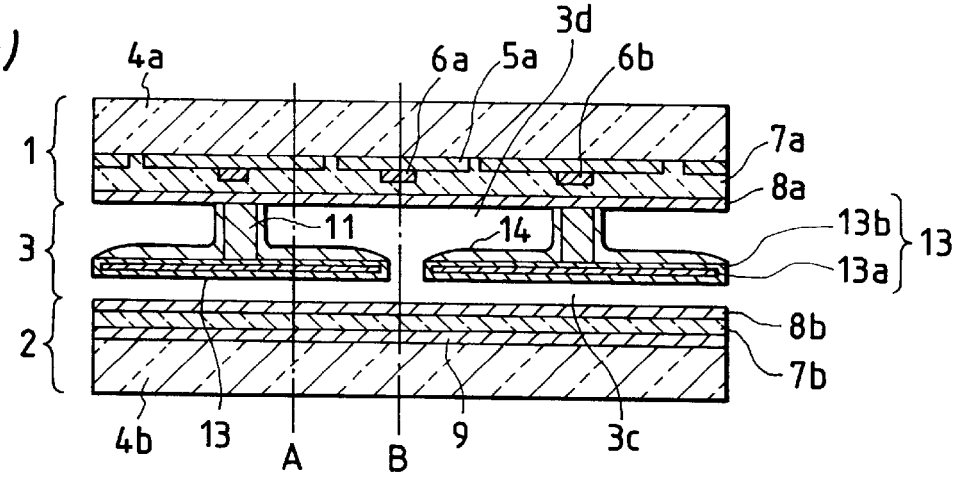
FIGS. 3(*a*)–3(*c*) show cross sectional views of a display panel manufactured in Example 3.
Figure 3B:
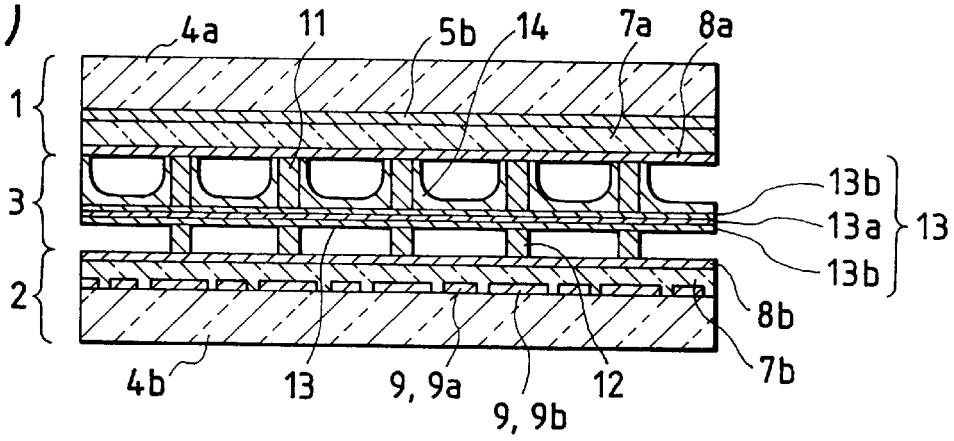
Figure 3C:
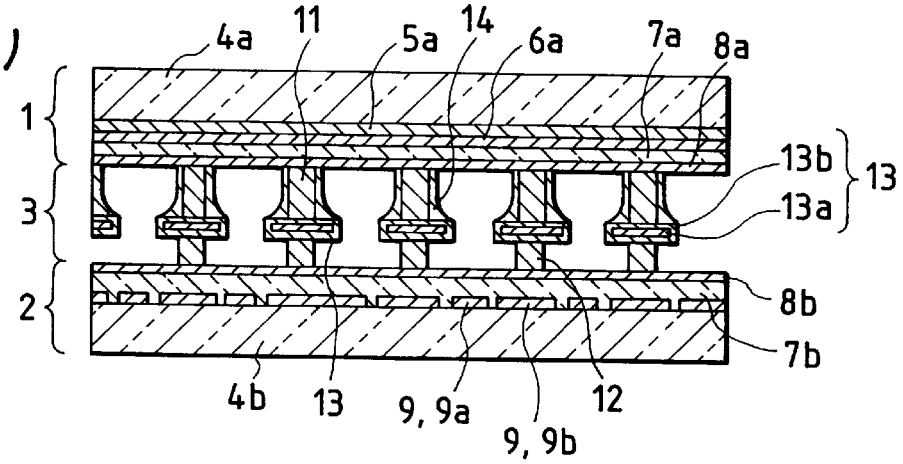
Figure 4:
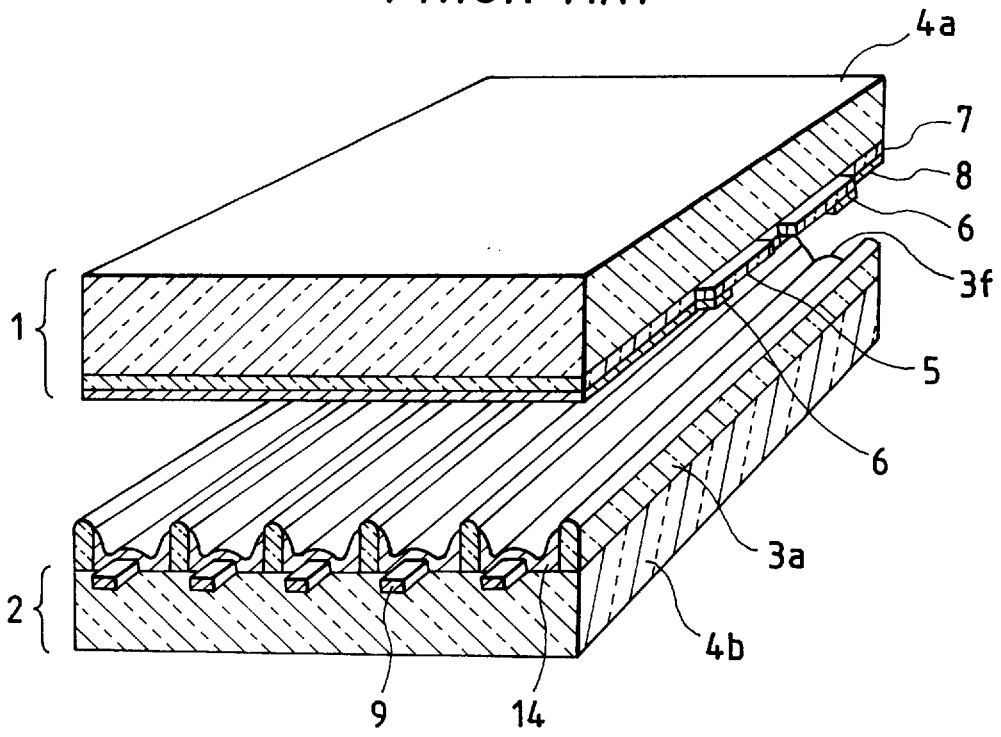
FIG. 4 PRIOR ART
FIG. 4 shows a perspective view illustrating a structure of a gas discharging type color display panel of the prior art.
Figure 6:
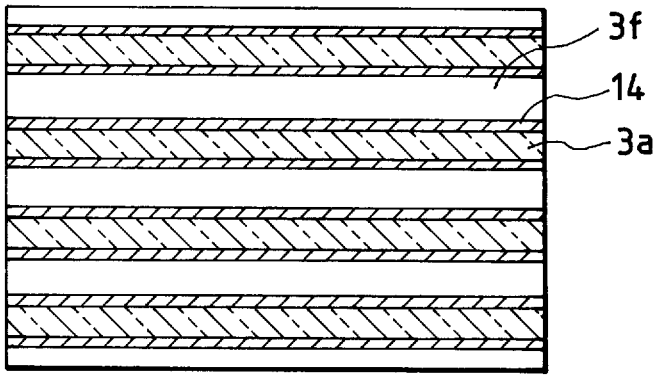
FIG. 6 PRIOR ART
FIG. 6 is an enlarged cross sectional view illustrating the structure of a barrier rib in a gas discharging type color display panel of the prior art.
Figure 5A:
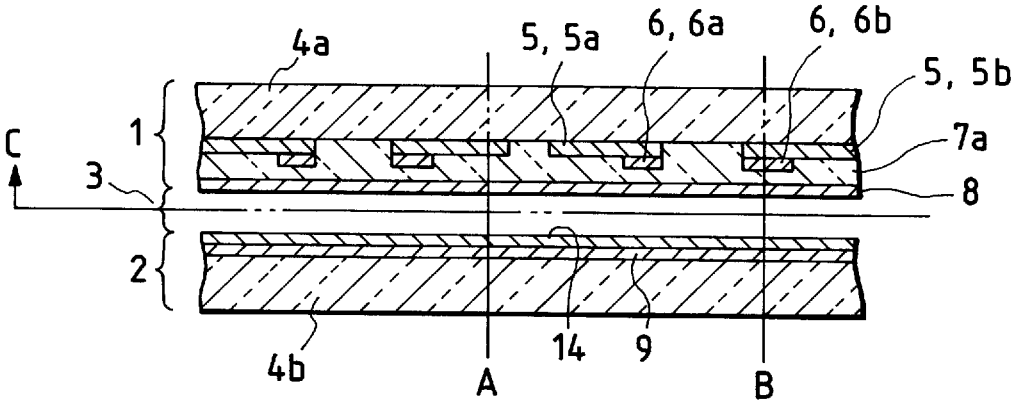
FIG. 5(a) PRIOR ART
FIGS. 5(*a*)–5(*c*) show cross sectional views of the structure of a gas discharging type color display panel of the prior art.
Figure 5B:
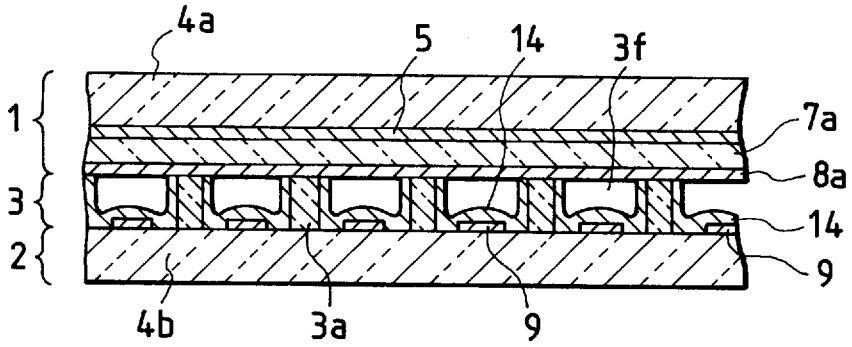
FIG. 5(b) PRIOR ART
Figure 5C:
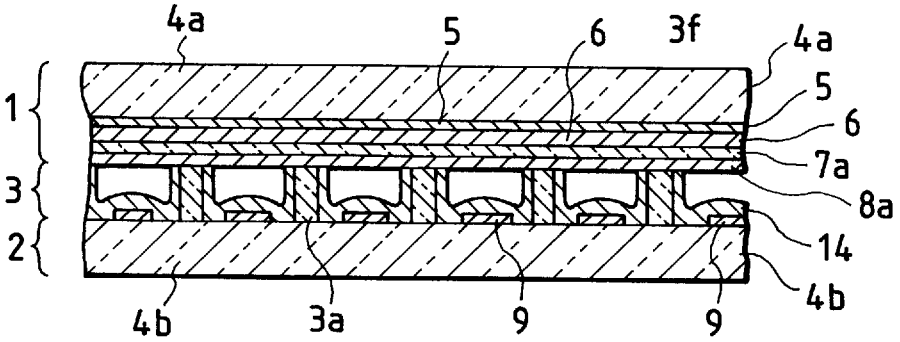
FIG. 5(c) PRIOR ART
Figure 10A:
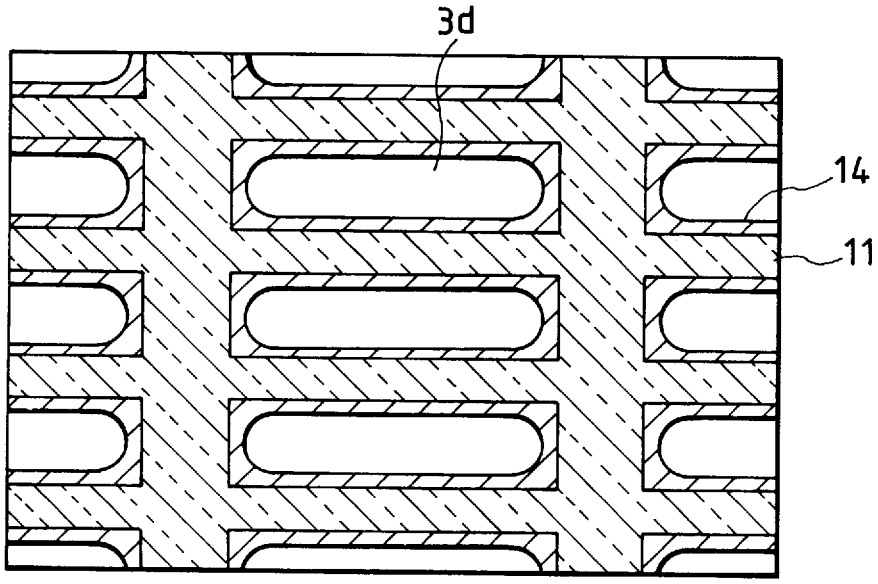
FIGS. 10(*a*) and 10(*b*) shows a cross sectional view illustrating the structure of a barrier rib in a gas discharging type color display panel of Example 3.
Figure 10B:
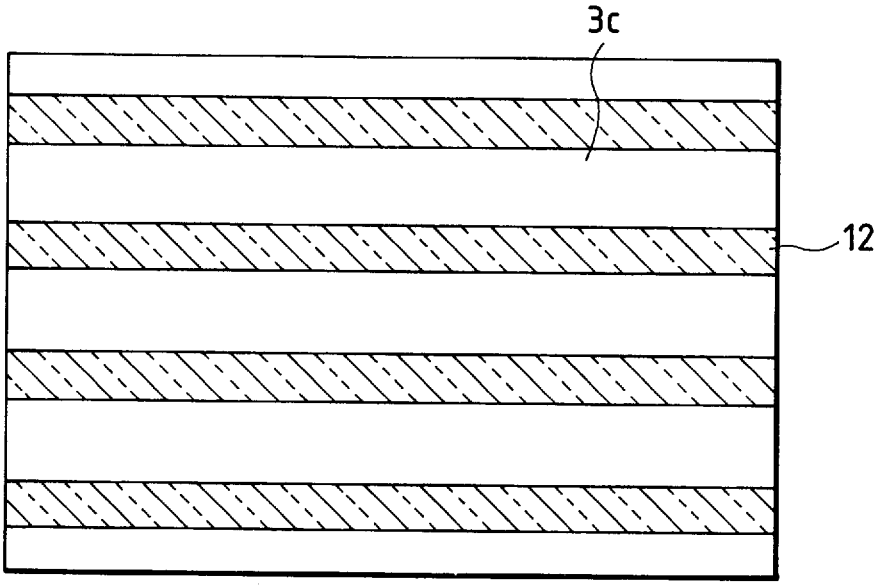

FIGS. 3(*a*)–3(*c*) show cross sectional views of a display panel manufactured in this embodiment. Like that in FIG. 1(*a*), FIG. 3(*a*) is a cross sectional view when a portion of a display panel of this embodiment is cut along a plane parallel with the address electrode 9 and vertical to the surface of substrates 1, 2. Further, FIG. 3(*b*) is a cross sectional view at a position A in FIG. 3(*a*) and a cutting plane thereof is vertical to the address electrode 9 and vertical to the surface of the substrates 1, 2. FIG. 3(*c*) is a cross sectional view at a position B in FIG. 3(*a*) and a cutting plane thereof is vertical to the address electrode 9 and vertical to the surface of the substrates 1, 2. FIGS. 10(*a*) and 10(*b*) shows a cross section of the barrier ribs 11 and 12 cut along a plane in parallel with the main surface of the front substrate 1. The size of the discharging space in the display panel manufactured in this embodiment is identical with that in Example 1.

In this example, a partition wall substrate 3 is manufactured in the same manner as in Example 1 by using a metal aluminum plate 3*a* of about 85 cm width, about 65 cm length and 0.2 mm thickness as the substrate material 3*a* for the partition wall substrate 3. However, after manufacturing the conduction path in step (6), the step (7) is not conducted and the molding product is covered with the insulation film like that in step (8), a hydrolysis type coating agent used in the step (2) of Example 1 mixed with a spherical aluminum particle and potassium titanate fiber as a binder (binder mixing ratio : 80 wt %) is coated at a predetermined position on the surface of the insulation film, and heated in the same manner as in step (2), to form a barrier rib 11 of 0.15 to 0.25 mm thickness.

Finally, when the front substrate 1, the partition or side wall substrate 3 not formed with the barrier rib 11 on the side of the front substrate and the barrier rib 12 on the side of the back substrate, and the back substrate 2 having the barrier rib 12 on the side of the back substrate manufactured in the same manner as in Example 2 are aligned and stacked in this order, the periphery is sealed in the same manner as in Example 1, He-5% Xe gas is sealed, and the chip pipe is chipped off to obtain a gas discharging type color display panel, a display panel of good contrast for color emission is obtained in the manner as in Example 1.

EXAMPLE 4

While the aluminum plate is used as the base material 3*a* for the partition wall substrate 3 in the Examples 1 to 3 described previously, the display panel is manufactured in this embodiment by using nickel, covar, stainless steel, 426 alloy, copper, magnesium, iron, cobalt, chromium, titanium, tantalum, tungsten or molybdenum, in the same manner as in Examples 1 to 3, whereby the same effects as those in Example 1 is obtained.

EXAMPLE 5

When a display panel is manufactured in the same manner as in Examples 1 to 3 except for applying fabrication by a laser fabrication method, a shaping method or a machining method instead of the etching method in the steps (6) and (7), same effects as those in Examples 1 to 3 can be obtained.

EXAMPLE 6

While the insulation layer 81 is formed in Examples 1 to 3 by using the gels of the composition of No. 11 in Table 1 as the hydrolysis type coating agent in Examples 1 to 3, a display panel is manufactured in the same manner as in Examples 1 to 3 by using the coating agent of the composition shown by No. 1–10 or 12 in this embodiment, whereby the same effects as those in Examples 1 to 3 is obtained.

EXAMPLE 7

While the insulation layer 81 is formed in Examples 1 to 3 by using the gel of the composition No. 11 in Table 1 as the hydrolysis type coating agent, a display panel is manufactured in the same manner as in Examples 1 to 3 by using a water glass of the composition of No. 1 to 11 or 12 in Table 2, as the coating agent, in this embodiment, whereby the same effects as those in Examples 1 to 3 is obtained.

EXAMPLE 8

In the formation of the insulation film 81, while the film of the hydrolysis type coating agent is formed by the dipping method in Examples 1 to 3, it is formed by a spray method or an electrodeposition method in this example, whereby the same effects as those in Examples 1 to 3 is obtained.

Figure 11:
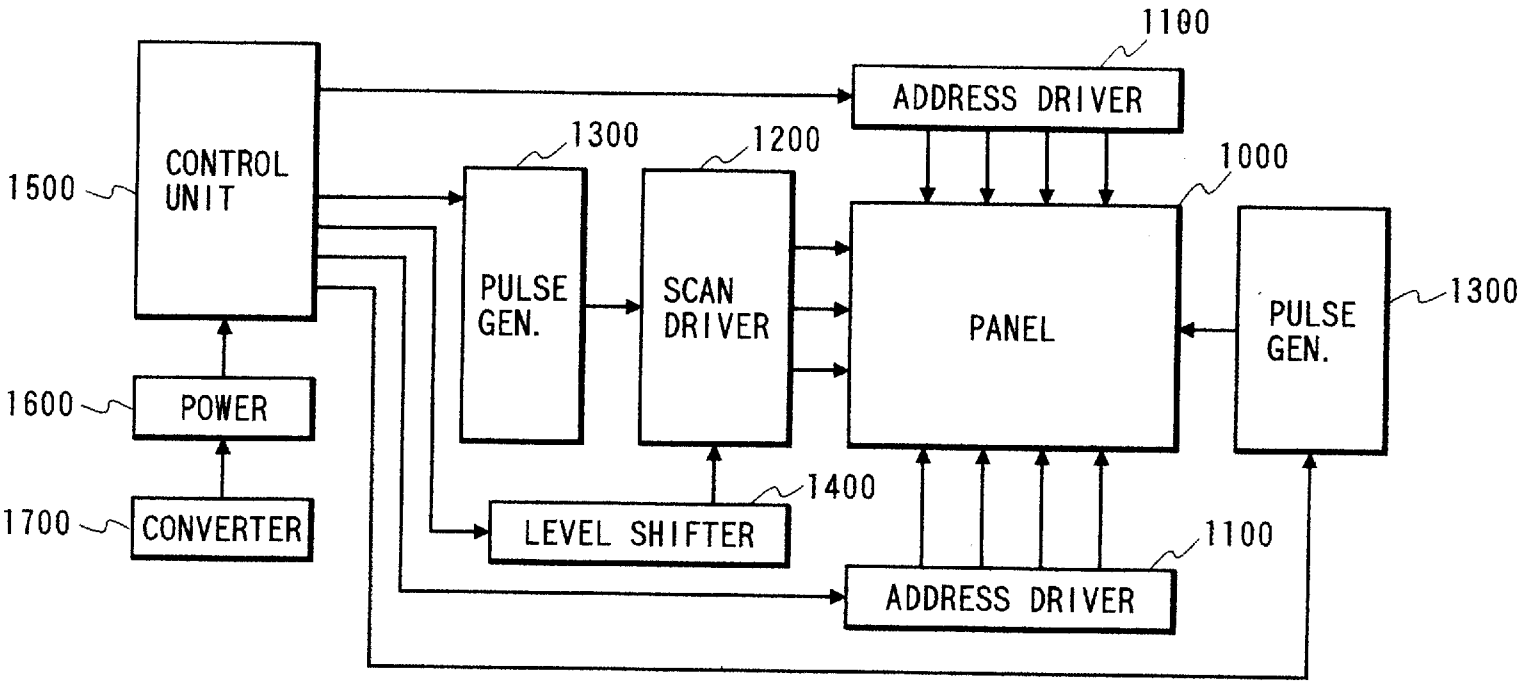
FIG. 11 shows a display system utilizing the gas discharge display panel of the present invention.

FIG. 11 shows a display system utilizing the gas discharge display panel of the present invention. As shown, address electrodes of the panel 1000 are supplied with signals from address drivers 1100 and other electrodes of the panel are supplied with signals from a scan driver 1200 and pulse generators 1300. The scan driver also being coupled to a level shifter 1400, and the drivers, pulse generators and level shifter being controlled by a control unit 1500 for providing the desired display. The control unit 1500 is coupled to a power control unit 1600 which is coupled to a converter, for example.

As has been described above, in the present invention, cells as picture elements are separated from each other by barrier ribs to form discharging cells, and partition walls are formed in each of the cells in parallel with the plane of the front substrate and the back substrate for concealing light by the auxiliary discharging, to constitute a display panel. Therefore, according to the present invention, since auxiliary discharging is generated by two parallel electrodes at the cell position formed on the back substrate, main discharging is generated by applying an AC voltage between two parallel electrodes formed on the front substrate by way of the conduction path and the fluorescent body is caused to emit light by ultraviolet rays generated by the discharging and, when the light permeating the front substrate is observed, since the light emission by the auxiliary discharging is concealed by the partition wall and only the light emission by the main discharging can be observed, a sufficient contrast can be obtained for the displayed images. Further, the driving voltage can also be lowered and, moreover, the working life can be increased.

Further, according to the present invention, since the barrier rib between each of the cells and the partition wall disposed parallel with the surface of the front substrate and the back substrate in each of the cells for concealing the auxiliary discharging can be constituted as a partition wall substrate, and they can be constituted so as to be handled as one part, printing for several times by a thick film printing method or the like is not required and improvement for the positional accuracy and improvement for the production yield can be attained.

Additionally, according to the method of manufacturing a gas discharging type color display panel of the present invention, the partition wall with high accuracy can be formed at a reduced cost by using a metal material covered with the insulation material for the partition wall substrate and, further, since the emitted light can be reflected on the surface of the metal, a panel at high luminosity can be obtained.

What is claimed is:

1. A partition member for an AC gas discharge display panel wherein the AC gas discharge display panel has a front substrate with at least one main discharge electrode spaced from a back substrate having at least one auxiliary discharge electrode so as to delimit a gap therebetween, the partition member extending substantially parallel to and between the front and back substrates for forming a main discharge space on a front substrate side and an auxiliary discharge space on a back substrate side, the partition member being a metal material member having an insulator on at least a portion thereof.

2. A partition member according to claim 1, wherein the metal material member comprises a substance forming an insulation oxide film when a surface thereof is oxidized.

3. A partition member according to claim 2, wherein the metal material member is at least one of metals of Al, Ti, Fe, Ta, W, Mo, Cu, Mg, Ni, Co and Cr and an alloy containing one of said metals.

4. A partition member according to claim 1, wherein the at least one main discharge electrode of the AC gas discharge display panel includes a pair of main electrodes disposed with respect to the main discharge space for enabling main discharge in the main discharge space and the at least one auxiliary discharge electrode includes a pair of auxiliary electrodes disposed with respect to the auxiliary discharge space for enabling auxiliary discharge therein.

5. An AC gas discharge display panel comprising:

a front substrate having at least one main discharge electrode thereon;

a back substrate having at least one auxiliary discharge electrode thereon, the back substrate being spaced from the front substrate so as to delimit a gap therebetween; and a partition member extending substantially parallel to and between the front and back substrates for forming a main discharge space on a front substrate side and an auxiliary discharge space on a back substrate side, the partition member being a metal material member having an insulator on at least a portion thereof.

6. An AC gas discharge display panel according to claim 5, further comprising a barrier rib connected at least at one end to at least one of the front substrate and back substrate for delimiting the gap between the front and back substrates, and a fluorescent layer, the partition member separating the space defined by the barrier rib into the main discharging space and the auxiliary space, the partition member having a penetration aperture therein for enabling communication of the main discharging space with the auxiliary discharging space.

7. An AC gas discharge display panel according to claim 6, wherein the at least one barrier rib comprises a metal material covered with an insulator for at least a surface exposed to the discharging space.

8. An AC gas discharge display panel according to claim 6, wherein the at least one barrier rib and the partition member are integral.

9. An AC gas discharge display panel according to claim 6, wherein the metal material of the metal material member comprises a substance forming an insulation oxide film when the surface is oxidized.

10. An AC gas discharge display panel according to claim 7, wherein the metal material constituting the at least one barrier rib comprises a substance forming an insulation oxide film when the surface is oxidized.

11. An AC gas discharge display panel according to claim 9 or 10, wherein the metal material is at least one of metals of Al, Ti, Fe, Ta, W, Mo, Cu, Mg, Ni, Co and Cr and an alloy containing one of said metals.

12. An AC gas discharge display panel according to claim 6 or 7, wherein the insulator has a first insulation film comprising an oxide of the metal material formed on the surface of the metal material.

13. An AC gas discharge display panel according to claim 12, wherein the insulator further has a second insulation film formed on a surface of the first insulation film and comprising an inorganic oxide obtained by heating a gel formed by hydrolysis of an organic metal compound or an aqueous solution of an alkali silicate.

14. An AC gas discharge display panel according to claim 6 or 7, wherein the insulator is an inorganic oxide obtained by heating a gel formed by hydrolysis of an organic metal compound or an aqueous solution of an alkali silicate.

15. An AC gas discharge display panel according to claim 6, wherein a surface of the fluorescent layer comprises an insulation layer made of an insulation material, and the fluorescent layer is provided on a lateral surface of the at least one barrier rib constituting an inner wall of the main discharging space and a surface of the main discharging space partition member.

16. An AC gas discharge display panel according to claim 5, wherein the at least one main discharge electrode of the AC gas discharge display panel includes a pair of main electrodes disposed with respect to the main discharge space for enabling main discharge in the main discharge space and the at least one auxiliary discharge electrode includes a pair of auxiliary electrodes disposed with respect to the auxiliary discharge space for enabling auxiliary discharge therein.

17. A gas discharge display panel according to claim 5, wherein the gas discharge display panel forms part of a display system, and further comprising a driving system for applying signals to the at least one auxiliary discharge electrode and the at least one main discharge electrode for driving the gas discharge display panel to effect display thereon.

* * * * *